US007625094B2

(12) United States Patent
Nakamura et al.

(10) Patent No.: US 7,625,094 B2
(45) Date of Patent: Dec. 1, 2009

(54) SWITCH LIGHTING EL SHEET AND LIGHTING SWITCH AND ELECTRONIC APPARATUS USING IT

(75) Inventors: Mitsuo Nakamura, Niiza (JP); Koji Shigenobu, Yokohama (JP); Shunichi Yamada, Kamiiso-gun (JP)

(73) Assignees: Toshiba Materials Co., Ltd., Yokohama-shi (JP); Sekonic Corporation, Tokyo (JP)

( * ) Notice: Subject to any disclaimer, the term of this patent is extended or adjusted under 35 U.S.C. 154(b) by 241 days.

(21) Appl. No.: 10/590,812

(22) PCT Filed: Feb. 24, 2005

(86) PCT No.: PCT/JP2005/002998

§ 371 (c)(1),
(2), (4) Date: Jan. 17, 2007

(87) PCT Pub. No.: WO2005/084079

PCT Pub. Date: Sep. 9, 2005

(65) Prior Publication Data

US 2007/0177370 A1 Aug. 2, 2007

(30) Foreign Application Priority Data

Feb. 26, 2004 (JP) ..... 2004-052371

(51) Int. Cl.
*F21V 33/00* (2006.01)

(52) U.S. Cl. ..... 362/84

(58) Field of Classification Search ..... 362/84
See application file for complete search history.

(56) References Cited

U.S. PATENT DOCUMENTS

| | | | |
|---|---|---|---|
| 5,643,496 | A | 7/1997 | Brese et al. |
| 6,595,653 | B2 | 7/2003 | Saito et al. |
| 6,936,783 | B2 | 8/2005 | Kawaguchi et al. |
| 6,984,799 | B2 | 1/2006 | Kawaguchi et al. |
| 2002/0030987 | A1 | 3/2002 | Saito et al. |
| 2002/0113226 | A1 | 8/2002 | Takehara et al. |

FOREIGN PATENT DOCUMENTS

| | | |
|---|---|---|
| CN | 1340835 | 3/2002 |
| CN | 1463458 | 12/2003 |
| EP | 0 818 793 | 1/1998 |
| EP | 1 035 557 | 9/2000 |

(Continued)

*Primary Examiner*—Laura Tso
(74) *Attorney, Agent, or Firm*—Oblon, Spivak, McClelland, Maier & Neustadt, L.L.P.

(57) ABSTRACT

A switch illuminating EL sheet (7) has a structure such that a transparent protection film (8), a transparent electrode layer (9), a light emitting layer (10), a dielectric layer (11) and a back electrode layer (12) are layered in order from a light emitting face side. The transparent protection film (8) has a thickness of 10 μm to 60 μm. Further, the transparent electrode layer (9) is constituted of a conductive polymer. Such an EL sheet (7) can suppress wire breakage or failure to light due to keystroke stress or the like without impairing reliability and clicking feeling of a key switch. The EL sheet (7) is arranged, for example, between a key top (1) and a switch mechanism portion (2) as a light source for illuminating the key top portion (1).

25 Claims, 1 Drawing Sheet

FOREIGN PATENT DOCUMENTS

| | | |
|---|---|---|
| JP | 6 70195 | 9/1994 |
| JP | 8 20772 | 1/1996 |
| JP | 9-325702 | 12/1997 |
| JP | 11-250758 | 9/1999 |
| JP | 11-260183 | 9/1999 |
| JP | 2000-340060 | 12/2000 |
| JP | 2001 185358 | 7/2001 |
| JP | 2002 56737 | 2/2002 |
| JP | 2002 173676 | 6/2002 |
| JP | 2003 201474 | 7/2003 |
| JP | 2004 39280 | 2/2004 |

SWITCH LIGHTING EL SHEET AND LIGHTING SWITCH AND ELECTRONIC APPARATUS USING IT

This application is a 371 of PCT/JP05/02998, filed Feb. 24, 2005, and claims priority to Japan 2004-052371 filed Feb. 26, 2004.

TECHNICAL FIELD

The present invention relates to a switch illuminating EL sheet used for illumination of a switch such as a key switch, and an illuminated switch and an electronic apparatus using the same.

BACKGROUND ART

In a mobile communication apparatus such as a cellular phone, PDA and the like, a CD player, an MD player, a small tape recorder, a remote control switch, or a small electric electronic apparatus mounted on a motor vehicle, illumination of a switch portion (such as a key top portion) of a key switch is performed. As a light source for such an illuminated switch in which a key top portion of a key switch is illuminated, generally a light bulb or an LED is adopted.

For the illuminated switch a structure having a key top, a switch mechanism portion such as a metal dome switch, a substrate and an LED as a light source is generally used. Incidentally, for mobile communication apparatuses such as a cellular phone and PDA, there is a strong demand to make a key switch thinner, and therefore a LED cannot be arranged under a key top. Accordingly, a common structure is such that an LED is arranged at a separate position from a key top and a switch mechanism portion, and light from the LED is diffused to illuminate the key top portion indirectly from the periphery. However, since the conventional illumination structure is not illumination from immediately under the key top, there are problems such that it is difficult to illuminate the key top portion evenly with adequate brightness, and that the structure becomes thick.

in this aspect, it is proposed to use an EL sheet having an electroluminescence (EL) element for the light source of an illuminated switch (for example, refer to patent documents 1 and 2). The EL sheet is a plane-like light source and has characteristics such that it is excellent for saving space due to its light weight, thinness and high flexibility in shape, and further it has low power consumption. Thus, the EL sheet can be arranged directly between the key top and the metal dome switch. According to an illuminated switch using such an EL sheet, it becomes possible to illuminate a key top from immediately under it.

As described above, the EL sheet is considered to be effective as an illumination light source for a key switch. However, according to results of experiments and considerations conducted by the present inventors, it is revealed that conventional EL sheets have weak points such as failure to illuminate after a short period of time due to keystroke stress from a key top, and malfunction of a switch and impairment of clicking feeling (feeling of pressing a switch) due to the stiffness of the EL sheet.

In a conventional EL sheet, generally, a film made by depositing or applying ITO (indium tin oxide) on a polyester film with a thickness of 75 μm or larger is used as a transparent electrode film. A deposited film of ITO has high light transmittance and high conductivity, but also has defects such as breaking easily by extension/contraction or increasing its electric surface resistance due to mechanical stress or heats.

Accordingly, it is revealed that when the EL sheet is bent due to keystroke stress from a key top, a crack is generated in an ITO electrode, which easily causes increase in resistance value, wire breakage and failure to illuminate. According to experiments conducted by the present inventor and others, by increasing the thickness of a base film of the ITO film, it is possible to suppress for a certain degree the failure of the EL sheet to illuminate, but in this case reliability and clicking feeling of the key switch are impaired.

Also, the present inventors have considered of making a transparent electrode using transparent conductive paint made by dispersing transparent conductive powder such as ITO in insulative resin. When a transparent electrode layer is formed using ITO paint or the like, it is possible to suppress for a certain degree the failure of the EL sheet to illuminate, but due to the need of increasing thickness or burning in order to make the resistance value of the transparent electrode to be low resistance, an applied film thereof stiffens during drying and curling becomes large. Therefore, it is difficult to produce the EL sheet using a thin base material. Even when using a thin base material, the transparent electrode layer stiffens due to inclusion of inorganic particles such as ITO. It is found that all of these can be a cause of impairing the clicking feeling. Further, a problem also arises such that a black dot is often generated on the EL sheet during illumination in a high-humidity environment.

By the way, in the aforementioned patent document 1, it is described that a slit is formed at a position along an outer periphery of a metal dome switch of an EL sheet, thereby improving a clicking characteristic. Also, in the patent document 2, an illuminated switch is described in which a transparent electrode film which is made by forming a transparent electrode layer on a base film, is formed in a dome shape, and an EL light emitting portion is formed inside a switch operating portion of this dome shape. Both of them use a deposited film of ITO for the transparent electrode layer, and thus problems such as wire breakage and increase in surface resistance due to the deposited film of ITO are not solved.

[Patent Document 1] JP-A 2002-56737 (KOKAI)

[Patent document 2] JP-A 2004-39280 (KOKAI)

DISCLOSURE OF THE INVENTION

An object of the present invention is to provide a switch illuminating EL sheet capable of repetitively suppressing wire breakage and failure to light due to keystroke stress or the like without impairing reliability and clicking feeling of a key switch, when being used as an illumination light source or the like for a key switch. Further, another object of the present invention is to provide an illuminated switch in which wire breakage and failure to light due to keystroke stress or the like are suppressed without impairing reliability and clicking feeling, and an electronic apparatus using such an illuminated switch.

A switch illuminating EL sheet according to the present invention is a switch illuminating EL sheet having a light emitting pattern corresponding to a switch, including a light emitting layer having EL phosphor particles which are contained dispersedly in a dielectric matrix, a transparent electrode layer arranged along a light emitting face of the light emitting layer and constituted of a conductive polymers a transparent protection film arranged on the transparent electrode layer and having a thickness of 10 μm to 60 μm, and a dielectric layer and a back electrode layer which are arranged in order along a non light emitting face of the light emitting layer.

An illuminated switch according to the present invention includes a switch illuminating EL sheet according to the present invention. The illuminated switch according to the present invention includes for example, a switch mechanism portion, a key top portion which operates the switch mechanism portion, and the switch illuminating EL sheet arranged between the switch mechanism portion and the key top portion and illuminating the key top portion. Further, an electronic apparatus according to the present invention includes an illuminated switch according to the present invention.

BEST MODE FOR CARRYING OUT THE INVENTION

Figure 1:
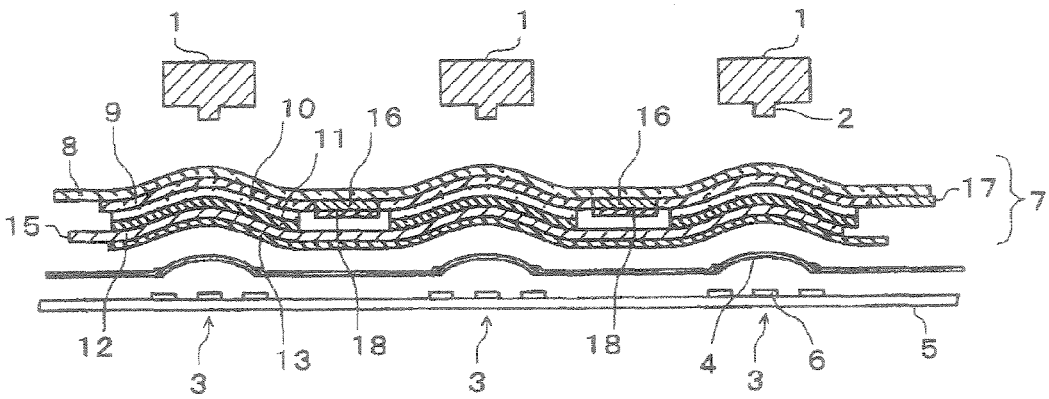
FIG. 1 is a cross-sectional view showing a configuration example of an illuminated switch using a switch illuminating EL sheet according to one embodiment of the present invention.
Figure 2:
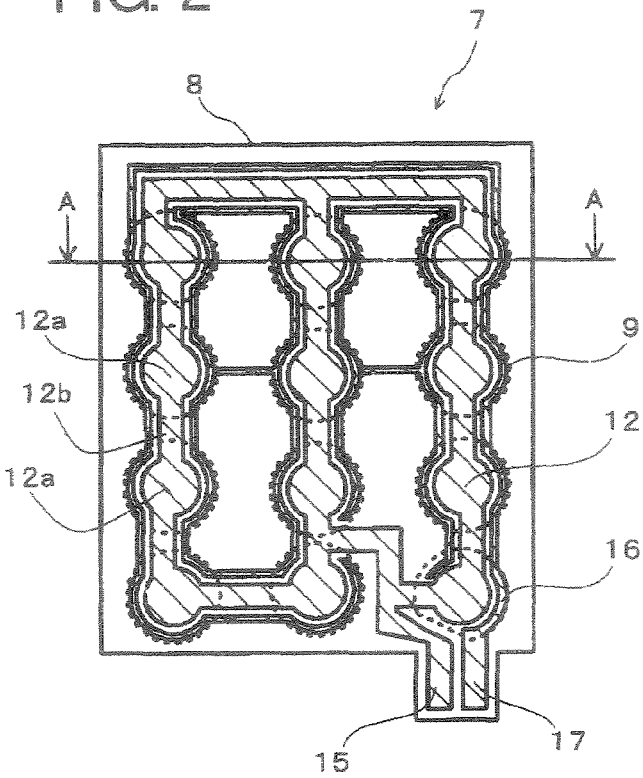
FIG. 2 is a plan view seeing the switch illuminating EL sheet according to the one embodiment of the present invention from a non light emitting face side (back electrode side).
Figure 3:
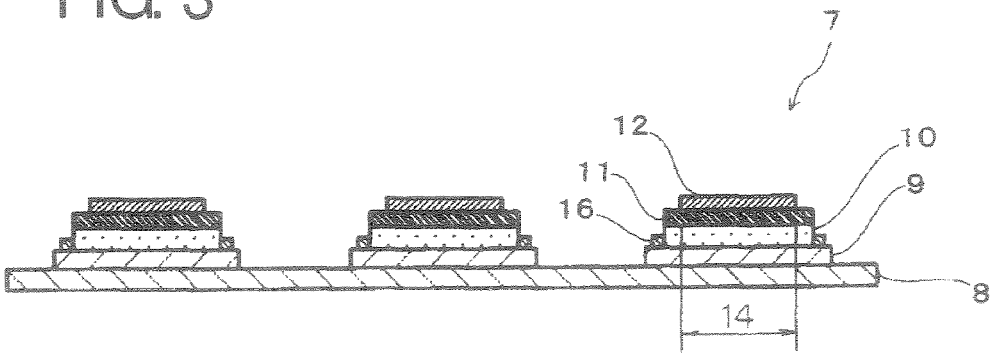
FIG. 3 is a cross-sectional view taken along an A-A line in FIG. 2.

Hereinafter, an embodiment of the present invention will be described. FIG. 1 is a cross-sectional view showing a schematic structure of an illuminated switch using a switch illuminating EL sheet according to one embodiment of the present invention as a light source. FIG. 2 is a plan view seeing the switch illuminating EL sheet according to the one embodiment of the present invention from a non light emitting face side (back electrode side), and FIG. 3 is a cross-sectional view taken along an A-A line in FIG. 2

In FIG. 1, 1 denotes a key top portion having a pressing projection portion 2, and corresponding to respective key top portions 1, metal dome type switch mechanism portions 3 are arranged. The switch mechanism portions 3 each have a dome type movable contact point 4 and a fixed contact point 6 arranged on a substrate 5. Then by pressing the movable contact point 4 by the pressing projection portion 2 of a key top portion 1, the switch mechanism portion 3 is turned on/off, and also clicking feeling is obtained.

Between the key top portions 1 and the switch mechanism portions 3 as described above, a switch illuminating EL sheet 7 is arranged as a light source for illuminating the key top portions 1. The EL sheet 7 has, as shown in FIG. 2 and FIG. 3, a structure of layering a transparent protection film 8, a transparent electrode layer 9, a light emitting layer 10, a dielectric layer 11, and a back electrode layer 12 in order from a light emitting face side. In other words, on a light emitting side main face (light emitting face) of the light emitting layer 10, the transparent protection film 8 with the transparent electrode layer 9 being formed on its surface is integrally layered and arranged. The transparent electrode layer 9 is arranged in contact with the light emitting layer 10.

Also, on a non light emitting side main face (non light emitting face) of the light emitting layer 10, the dielectric layer 11 is formed by layering in which inorganic oxide powder having high reflexivity and a high dielectric constant such as $TiO_2$ or $BaTiO_3$ for example is diffused and contained into organic macromolecules having a high dielectric constant such as cyanoethyl cellulose or fluorine rubber. Furthermore, the back electrode layer 12 is formed by layering integrally via the dielectric layer 11. Also, on the back electrode layer 12, a back insulation layer 13 is formed by layering as necessary. By integrally forming the back insulation layer 13 with the EL sheet 7, a component such as the switch mechanism portion 3 is electrically insulated from the EL sheet 7, and also damage to the back electrode layer 12 due to keystroke stress can be reduced.

The switch illuminating EL sheet 7 has a light emitting portion pattern corresponding to the key top portions 1. Specifically, among the respective constituting layers of the EL sheet 7, the transparent electrode layer 9, the light emitting layer 10 and the dielectric layer 11 have a shape corresponding to the pattern of light emitting portions 14. The back electrode layer 12 is formed integrally of electrode portions 12*a* corresponding to the shape of each light emitting portion 14 and power supply wires 12*b* connecting these light electrode portions 12*a*, as shown in FIG. 2. To the power supply wire 12*b* for the back electrode, a first power supply terminal 15 is connected. The transparent electrode layer 9 having the shape corresponding to the light emitting portions 14 are connected by a power supply wire 16, and to this power supply wire 16 for transparent electrodes, a second power supply terminal 17 is connected. The surface of the power supply wire 16 for transparent electrodes is covered by an insulation layer 18 as shown in FIG. 1.

The transparent electrode layer 9 is constituted of a conductive polymer having translucency A specific example of the conductive polymer constituting the transparent electrode layer 9 is a polymer whose main constituent is at least one type selected from polyacethylene, polyphenylene, polyphenylene vinylene, polyphenylene acetylene, polypyrrole, polythiophene, polyethylene dioxythiophene, polyaniline, and the like. Paint including such a conductive polymer is applied on a surface of the transparent protection film 8 and dried to form the transparent electrode layer 9. Especially an applied film of polyethylene dioxythiophene (PEDOT)-polystyrene acid (PSS), which are a complex of conductive macromolecules is excellent in conductivity and translucency, and thus is preferable for the transparent electrode layer 9.

The transparent electrode layer 9 constituted of a conductive polymer as described above are excellent in durability against mechanical stress, so that occurrence of wire breakage, failure to light or the like due to keystroke stress can be largely suppressed. However, it cannot be said that it always has sufficient conductivity and light transmittance as compared to the ITO film (having for example surface resistance of 300Ω/□ light transmittance of 85% or higher) applied to a transparent electrode of a conventional EL sheet. When applying the conductive polymer to the transparent electrode layer 9, its light transmittance can be increased by thinning its thickness, but it easily causes decrease in reliability with respect to film breakage due to keystroke stress, local increase in conductivity, and so forth.

Accordingly, for increasing the reliability of the switch illuminating EL sheet 7, it is preferable that the transparent electrode layer 9 has a mean thickness of 0.1 μm or larger and surface resistance of 1000Ω/□ or lower. It is more preferable that the mean thickness of the transparent electrode layer 9 is 1 μm or larger. Also, in order not to impair reliability, clicking feeling and so forth of a key switch, it is preferable that the mean thickness of the transparent electrode layer 9 is 5 μm or smaller.

When the mean thickness of the transparent electrode layer 9 is made larger its light transmittance becomes for example, lower than 80%. The decrease in the light transmittance of the transparent electrode layer 9 may cause decrease in the light emitting luminance of the EL sheet 7. Then, as will be described in detail later, it is preferred to be used in combination with the light emitting layer 10 having a high-luminance EL phosphor (electric field light emitting phosphor). Using the transparent electrode layer 9 constituted of a conductive polymer in combination with the high-luminance EL phosphor, excellent luminance for key switch illumination can be obtained. Specifically, under driving conditions of a voltage of 100 V and a frequency of 400 Hz, luminance of 50 cd/m$^2$ or higher can be realized. Thus, practical problems such as enlargement of a drive power supply, decrease in operating life due to increase in output power, and inability to obtain practical luminance can be avoided.

For the transparent protection film 8 to be a base material for forming the transparent electrode layer 9, a single film or layered films of polyethylene terephthalate (PET), polyethersulfone (PES), polyimide, nylon, fluoropolymer, polycarbonate, polyurethane rubber and the like, which are general purpose macromolecule films having excellent mechanical strength, can be used. Here, the thickness of the transparent protection film 8 is crucial to have both durability against keystroke stress and flexibility affecting the clicking feeling or the likes. Specifically, the transparent protection film 8 may have a thickness in the range of 10 μm to 60 μm. If the transparent protection film 8 has a thickness smaller than 10 μm the wire breakage due to keystroke stress or the failure to light cannot be suppressed repetitively. On the other hand, if the transparent protection film 8 has a thickness larger than 60 μm the clicking feeling is impaired.

According to experimental results by the present inventors, when a PET film having a thickness of 9 μm is used, film breakage easily occurs by keystroke stress of less than one million times. This causes a dot defect or the like. On the other hand, when a PET film having a thickness of 12 μm is used, minute defects occur but it exhibits a sufficient function as illumination for a key switch even after the number of keystrokes exceeded one million times. With a PET film having a thickness of 25 μm, film breakage does not occur even after the number of keystrokes exceeded one and a half million times. On the other hand, if the thickness of the transparent protection film 8 becomes too large, its stiffness increases and disturbs the clicking feeling as a key switch. With a PET film having a thickness of 63 μm, sufficient clicking feeling is not obtained. From these facts, it is preferable that the thickness of the film 8 is 10 μm to 60 μm, and more preferably, 20 μm to 40 μm.

The transparent electrode layer 9 constituted of a conductive polymer are made as paint and applied on the above-described transparent protection film 8. At this time, for the reasons such as bend due to dimensional accuracy or applied film contraction, workability or the like, it is preferable that the thickness of the applying base material is 50 μm or larger. With this regard, for example, a thin EL sheet having excellent clicking feeling can be obtained as follows. Specifically, a transparent film having a releasing characteristic is formed by printing on a thick base material film, the conductive polymer made as paint is applied thereon to form the transparent electrode layer, and another layer is formed further thereon to produce the EL sheet. Thereafter, the base material film is peeled off. However, an EL sheet made by such a method breaks easily because it is formed of a thin resin coating, and thus has a problem in durability and practicability. Also when adhering a key top, a switch part or the like or when forming a color filter, sufficient adhering strength cannot be obtained.

Accordingly, it is preferable to use, as the application base material one made by adhering a thick base material film (having a thickness of 50 μm or larger for example) on the transparent protection film 8 having a thickness of 60 μm or smaller via a light adhesive layer. Using such an adhered film as the application base material, facilities for conventional EL manufacturing processes can be used. In this manner, a difficult production technology owing to film thinness or expensive equipment such as a thin film printing apparatus, dryer and conveying mechanism are not necessary, whereby it is possible to suppress increase in manufacturing costs of the switch illuminating EL sheet 7. After the EL sheet 7 is produced, the base material film can be peeled off to prevent impairment of clicking feeling or the like.

Further in a process of combining with parts such as a key top, a switch and so forth the EL sheet having a thickness smaller than 50 μm may be a hindrance to mass production due to its difficulty for handling and poor efficiency. Introducing it into a production process with the light adhesive base material film being adhered thereon in a range not impairing the clicking feeling can provide means for simple integration. Moreover, the transparent protection film 8 itself may be constituted of layers of two or more base materials. Using such a transparent protection film 8 constituted of layers of two or more base materials, the adhesive layer and the plural base materials function as a buffer layer for hitting so that the hitting durability can be increased further.

When the transparent protection film 8 is constituted of layers of two or more base materials each base material is not limited to a macromolecule material. For example, layered films made by forming a metal oxide layer of silicon oxide ($SiO_x$) aluminum oxide ($AlO_x$), titanium oxide ($TiO_x$), or the like or a metal nitride layer of silicon nitride (SiN) aluminum nitride (AlN) or the like on the macromolecule films as described above can be used. The metal oxide layer and the metal nitride layer function as a damp proof layer. Therefore, using the transparent protection film 8 having such a layer, reliability of the transparent electrode layer 9 constituted of a conductive polymer having relatively low high-humidity environment characteristics can be increased.

The conductive polymer forming the transparent electrode layer 9 has relatively weak adhesiveness to a resin film such as polyester, and thus film peeling may occur due to keystroke stress. In this aspect, by adding an easy-adhesion layer to the transparent protection film 8, adhesive strengths of the transparent electrode layer 9 constituted of the conductive polymer and the transparent protection film 8 increase. This prevents film peeling due to keystroke stress, and thus the reliability can be further improved. In the case of providing a pigment filter or the like for converting luminescent color, the same effect can be obtained. Further, by performing easy-adhesion processing on both sides of the transparent protection film 8 in advance, coating strength is enhanced in the case of performing filter printing or the like, and it is not necessary to consider distinction of processing faces, which improves the productivity.

The light emitting layer 10 formed on the transparent protection film 8 having the transparent electrode layer 9 contains EL phosphor particles as an electric field light emitting source. As the EL phosphor particles, it is preferable to apply a ZnS-based phosphor such as a copper-activated zinc sulfide (ZnS:Cu) phosphor emitting blue or blue green color for example, a copper-activated zinc sulfide (ZnS:Cu, Cl) phosphor further containing a minute amount of chlorine as flux, or the like. Such EL phosphor particles are arranged dispersedly in a dielectric matrix constituted of an organic macromolecule material having a high dielectric constant such as cyanoethyl cellulose or fluorescent rubber for example. In other words, the light emitting layer 10 is a phosphor layer of an organic dispersion type in which EL phosphor particles constituted of an inorganic material is dispersedly arranged in a dielectric matrix constituted of an organic material.

Incidentally, the EL phosphor particles constituting the light emitting layer 10, specifically the ZnS:Cu phosphor particles, are vulnerable to moisture, and has a weak point to easily deteriorate in its characteristics (luminance and the like) by moisture in the air. Accordingly, it is preferable to use for the light emitting layer 10 an EL phosphor particle covered by a substantially transparent damp-proof coating, a so-called damp-proof coated EL phosphor particle. As the damp-proof coating for an EL phosphor particle, a metal oxide film, a metal nitride film or the like is used for example. The type of the metal oxide film is not particularly limited, and it is preferable that at least one kind selected from silicon oxide, titanium oxide, and aluminum oxide in view of damp-proof characteristic, light transmitting characteristic, insulation characteristic, and so forth. Also, examples of the metal nitride film include silicon nitride, aluminum nitride, and the like.

It is preferable that the damp-proof coating constituted of a metal oxide film, a metal nitride film or the like is formed by applying a chemical vapor deposition (CVD) method in view of evenness of the film, manufacturing costs and so forth. Especially, in view of deterioration in luminance of the EL phosphor due to heat, film-formability on a powder surface in a fluid state, and further environmental safety and the like during mass-production, it is desirable to use a material that does not explode or burn and use a reaction system having high reactivity at a low temperature (200° C. or lower). Examples of such a reaction system include $SiCi_4+2H_2O \rightarrow SiO_2+4HCl$, $TiCl_4+2H_2O \rightarrow TiO_2+4HCl$, and the like. The film thickness of the damp-proof coating is preferred to be in the range of 0.1 μm to 2 μm as its mean thickness.

The deterioration of an EL phosphor due to moisture can also be prevented by covering the entire EL sheet 7 with a damp-proof film (polychloro-tetrafluoroethylene film or the like). However, it thickens the entire EL sheet 7, and impairs reliability and clicking feeling of a key switch. On the other hand, using the damp-proof coated EL phosphor particle, it is possible to suppress deterioration of characteristics of the EL phosphor due to moisture without using a damp-proof film or a moisture absorption film. Specifically, applying the light emitting film 10 containing the damp-proof coated EL phosphor particles as the switch illuminating EL sheet 7, it is possible to suppress the deterioration of characteristics of the EL phosphor due to moisture without thickening the entire EL sheet 7.

Further, it is preferable to use a high-luminance EL phosphor for the light emitting layer 10 as described above, in order to compensate the deterioration of light transmittance of the transparent electrode layer 9 constituted of a conductive polymer. Specifically, it is preferable to use the transparent electrode layer 9 constituted of a conductive polymer and the light emitting layer 10 containing high-luminance EL phosphor particles in combination. Here, the ZnS-based EL phosphor is generally made by burning a phosphor material under conditions such that crystals of copper-activated zinc sulfide grow sufficiently. A mean particle diameter of such ZnS-based EL phosphor particles is approximately 25 μm to 35 μm. With an EL phosphor applying such a method, it is becoming difficult to increase for ability, flexibility hitting durability, luminance and so forth to demanded levels when forming the EL sheet 7.

On the other hand, in U.S. Pat. No. 5,643,496, an EL phosphor constituted of a ZnS:Cu phosphor with a mean particle diameter of 23 μm or smaller is disclosed. This small-particle ET phosphor is obtained by controlling manufacturing conditions (burning condition and so forth) of the EL phosphor without conducting manipulation such as sifting. The above publication describes that reduction in particle size of the EL phosphor improves luminance and an operating life characteristic of the EL element or the like using it. However an EL sheet formed using such a small-particle EL phosphor obtained by controlling only manufacturing conditions cannot always achieve sufficient luminance. This is due to the fact that the small-particle EL phosphor for which only manufacturing conditions are controlled may result in deterioration of its own luminance characteristic.

Accordingly, it is preferable to perform a classification operation or the like on phosphor particles produced with ordinary burning conditions and use EL phosphor particles from which coarse phosphor particles are removed. Specifically, it is preferable to use EL phosphor particle powder which have a mean particle diameter of 10 μm to 23 μm represented by a 50% D value by removing coarse phosphor particles (coarse particle constituents) by a classification operation or the like, and also have a particle distribution having a ratio of constituents having a particle diameter of 25.4 μm or larger is 30% or less by mass. With an EL phosphor having such a mean particle diameter and a particle size distribution, since it can increase the number of EL phosphor particles per unit volume in the light emitting layer 10 it is possible to increase not only the luminance of the light emitting layer 10 but also improve for ability, flexibility, hitting durability and so forth of the EL sheet 7.

if the mean particle diameter of the EL phosphor particles is smaller than 10 μm, it is possible that the light emitting luminance of the EL phosphor particles themselves decreases. On the other hand, if the mean particle diameter of the EL phosphor particles exceeds 23 μm, the number of EL phosphor particles per unit volume in the light emitting layer 10 decreases, and it is possible that the luminance of the light emitting layer 10 itself decreases. The same applies to a case that the ratio of constituents having a particle diameter of 25.4 μm or larger exceeds 30% by mass. It is more preferable that the mean particle diameter of the EL phosphor particles is in the range of 13 μm to 20 μm. Further, it is more preferable that the ratio of constituents having a particle diameter of 25.4 μm or larger in the EL phosphor particles is 15% or lower by mass. A high-luminance EL phosphor satisfying the above-described conditions has luminance of 80 cd/$m^2$ or higher under drive conditions of a voltage of 100 V and a frequency of 400 Hz, when an EL element is produced using a transparent electrode having for example light transmittance of 85% or higher and surface resistance of 500Ω/□ or lower for example.

Moreover, when the transparent protection film 8 which is thin is used, it is possible that the transparent electrode layer 9 constituted of a conductive polymer and the transparent protection film 8 are damaged by corners of coarse phosphor particles to thereby generate dots. Also, the conductive polymer may deteriorate in a short period of time when a current density during driving becomes high in a high-humidity environment. The coarse phosphor particles easily lead to concentration of electric fields at a contact point with the conductive polymer, and thus it may cause deterioration of the conductive polymer and generation of black dots by that. Also from such view points, it is preferable to use the EL phosphor having the mean particle diameter of 23 μm or smaller and the ratio of constituents having a particle diameter of 25.4 μm or larger being 30% or lower by masse.

When the above-described EL phosphor particle constituted of a ZnS:Cu phosphor is applied to the light emitting layer 10, generally its emitting light color becomes blue or blue green. For the purpose of converting such emitting light color, a pigment such as an organic phosphor pigment may be added to the light emitting layer 10. However, when a pigment is added to the light emitting layer 10 by high concentration, its moisture absorption rate becomes high, which makes the resistance value of the transparent electrode layer 9 constituted of a conductive polymer liable to rise in a high-temperature, high-humidity environment. Accordingly, the pigment layer is preferred to be formed on one face or both faces of the transparent protection film 8. With such a structure, emitting light color of the light emitting layer 10 can be converted efficiently with high reliability.

Further, other than the purpose of converting the emitting light color of the light emitting layer 10, a pigment layer for example as a light diffusion layer for changing appearing color may be formed. For example, by adding a light diffusion layer with a white pigment, unevenness in application of the transparent electrode layer 9 constituted of a conductive polymer and the light emitting layer 10 can be made obscure. The conductive polymer can be colored strongly and easily generates unevenness in application by screen printing or the like. Also, the light emitting layer 10 may cause roughness in emitting color in a case of lowering a phosphor density or the like so as to give priority to thinning the thickness. The light diffusion layer mitigates these influences and contributes to improvement of appearance and quality thereof.

The pigment layer may be arranged between the transparent electrode layer 9 and the light emitting layer 10. When adopting such a structure, it is preferable to form the pigment layer by applying paint made by mixing a pigment with a highly adhesive binder on the transparent protection film 8 having the transparent electrode layer 9. With such a pigment layer, in addition to a conversion effect of emitting color and appearing color, an effect to increase adhesiveness of the transparent protection film 8 having the transparent electrode layer 9 and the light emitting layer 10 can be obtained.

When forming the pigment layer as described above, typical paint including a pigment often has a solid content ratio (mass ratio) of the pigment exceeding 50% in order to decrease the number of times of printing. When using paint having a high pigment ratio, it becomes liable to absorb moisture, and therefore may lead to decrease of the resistance value of the conductive polymer. Also, when the pigment ratio is high a film quality becomes porous and lacks smoothness, and therefore the surface resistance of the transparent electrode layer 9 formed by printing thereon may rise to 2000Ω/□ or higher for example, whereas 1000Ω/□ or lower can be obtained by forming on a smooth film by 200-mesh printing. Then, it is preferable that the pigment layer is formed using paint including a pigment with a compounding ratio of the pigment (mass ratio of the solid content) being 50% or lower. In this manner, even when a pigment layer is used as a base for the transparent electrode layer 9, it is possible to suppress increase in resistance value of the transparent electrode layer 9.

In the EL sheet 7 using the above-described damp-proof coated EL phosphor particles, the back electrode layer 12 is formed by applying metal powder such as Ag powder or Cu powder, carbon powder such as graphite powder, or mixed powder thereof or the like. Specifically, the light emitting layer 10 is formed by applying it on the transparent protection film 8 having the transparent electrode layer 9, the dielectric layer 11 and the back electrode layer 12 are formed further by applying them in this order on the light emitting layers 10, and thereafter this layered body is integrated by thermo compression bonding or the like, thereby producing the switch illuminating EL sheet 7. Note that when forming the back insulation layer 13 on the back electrode layer 12, it is preferable that the back insulation layer 13 is formed by application on the back electrode layer 12 in the same application forming step.

For the structure of such a switch illuminating EL sheet 7 other than the respective constituting layers, a structure similar to a typical EL sheet may be adopted. Further, regarding the power supply wires 12*b* connecting the electrode portions 12*a* corresponding to the shape of the light emitting portions 14 of the back electrode layer 12 and the power supply wire 16 connecting the transparent electrode layer 9 having a shape corresponding to the light emitting portions 14, it is preferable to form more than two systems of wires. The power supply wires 12*b* for the back electrode and the power supply wire 16 for the transparent electrode, which are shown in FIG. 2, are both have two systems of wires. With such a structure, even when increase in resistance value, wire breakage or the like occurs on one of the two systems due to bending caused by formation or keystroke, hitting stress or the like, it is possible to suppress failure of the EL sheet 7 to light. Thus, the reliability of the switch illuminating EL sheet 7 can be increased further. Moreover, if having two or more independent light emitting portion patterns, it is also possible to independently light each light emitting portion by two or more systems of wires.

Further, for improvement of keystroke durability or the like of the switch illuminating EL sheet 7, a soft pad constituted of polyurethane resin or the like having a thickness of 2 μm to 50 μm for example may be arranged at a position corresponding to the center of a light emitting portion 14 on at least either of a front face or a back face of the EL sheet 7. Arranging such a pad improves absorption efficiency of keystroke stress or the like, and therefore the reliability of the switch illuminating EL sheet 7 can be. Increased further. The arranging position of the pad may be between the transparent protection film 8 and the transparent electrode layer 9 or between the back electrode layer 12 and the back insulation layer 13, and the pad can be arranged at ether or both of them.

In the switch illuminating EL sheet 7 of the above-described embodiment, a conductive polymer having excellent durability against keystroke stress or the like is used for the transparent electrode layer 9 and a transparent protection film 8 which has both flexibility and a keystroke durability characteristic is used. Accordingly, the switch illuminating EL sheet 7 that is excellent in keystroke durability and does not impair reliability and clicking feeling of a switch can be provided. Further, using the transparent electrode layer 9 constituted of a conductive polymer and the light emitting layers 10 containing high-luminance EL phosphor particles in combination, it is possible to compensate decrease in light transmittance of the transparent electrode layer 9 and thus the luminance characteristic of the EL sheet 7 can be maintained sufficiently. Specifically, in the case of using the damp-proof coated EL phosphor particle, luminance of 50 cd/m$^2$ or higher can be obtained under drive conditions of a voltage of 100 V and a frequency of 400 Hz.

According to the switch illuminating EL sheet 7 as such, the key tops 1 can be illuminated evenly with sufficient luminance from immediately under them, and moreover, durability and reliability of an illuminated switch can be improved largely. The switch illuminating EL sheet 7 in this embodiment is preferable as a light source for an illuminated switch combining a key top portion 1 and a metal dome type switch mechanism portion 3. The illuminated switch using the switch illuminating EL sheet 7 is used preferably for example in a mobile communication apparatus such as a cellular phone or PDA, for which there are strong demands for thinning of key switches.

Examples of electronic apparatuses according to the embodiment of the present invention include a mobile communication apparatus such as a cellular phone and PDA having illuminated switches using the switch illuminating EL sheet 7. It should be noted that the range of application of the switch illuminating EL sheet according to the present invention is not limited to an illuminated switch having a metal dome type switch mechanism portion, and the present invention is applicable to various types of illuminated switches which illuminate a switch portion such as a key top from immediately under it. Also, such an apparatus applying the illuminated switch is not limited to the electronic apparatus such as a mobile communication apparatus, and it is applicable to various types of electric/electronic devices.

Next, specific examples of the present invention and evaluation results thereof will be explained.

EXAMPLE 1

First, a ZnS-based EL phosphor was produced as follows. Specifically, 1 L (liter) of pure water was added to 100 g of zinc sulfide powder having a particle diameter of approximately 1 μm to 3 μm to make slurry, to which 0.25 g of copper sulfate (5 hydrates) and 40 g off magnesium chloride, 40 g of barium chloride, 20 g of sodium chloride were added as crystal growth agents (flux) and mixed them adequately. This slurry mixture was dried, filled in a quartz crucible and burned for four hours at a temperature of 1150° C. in the air.

Next, the above-described burned matter was subjected to washing and drying processing, and thereafter 15 g of zinc oxide was mixed per 300 g of the burned matter, and this mixture was filled in a quartz crucible and burned for 1.5 hour at a temperature of 750° C. in the air. This burned matter was dispersed into pure water and washed three times. Further, acid washing with a condition of pH=1.5 and neutralizing washing with pure water were performed, and it was filtered, dried and thereafter sifted with a 325-mesh sifter to obtain a ZnS:Cu phosphor (El phosphor). Also, this phosphor includes a minute amount of chlorine which is used as flux.

A particle distribution of the ZnS:Cu phosphor obtained in this manner was measured using a particle analyzer (made by BECKMAN COULTER, Inc., product name: Multisizer TM3). Results thereof are shown in Table 1. From these measurement results of the particle distribution, a 50% D value was obtained as a mean particle diameter, and the 50% D value of the ZnS:Cu phosphor powder was 26.3 μm. Also, a ratio of coarse particle constituents having a particle diameter of 25.4 μm or larger was 54.5% by mass. Note that Table 1 also shows the particle distribution of a ZnS:Cu phosphor produced in later-described example 3.

TABLE 1

| Particle diameter range (μm) | Particle ratio (%) Example 1 | Example 3 |
|---|---|---|
| 1.587-2.000 | 0.0 | 0.0 |
| 2.000-2.519 | 0.0 | 0.0 |
| 2.519-3.174 | 0.0 | 0.0 |
| 3.174-3.999 | 0.0 | 0.0 |
| 3.999-5.039 | 0.0 | 0.0 |
| 5.039-6.349 | 0.0 | 0.0 |
| 6.349-7.999 | 0.1 | 0.1 |
| 7.999-10.08 | 0.3 | 0.7 |
| 10.08-12.70 | 1.5 | 5.1 |
| 12.70-16.00 | 5.5 | 18.8 |
| 16.00-20.16 | 13.0 | 32.1 |
| 20.16-25.40 | 25.1 | 28.8 |

TABLE 1-continued

| Particle diameter range (μm) | Particle ratio (%) Example 1 | Example 3 |
|---|---|---|
| 25.40-32.00 | 32.7 | 11.5 |
| 32.00-40.32 | 18.4 | 2.3 |
| 40.32-50.80 | 2.2 | 0.6 |
| 50.80-64.00 | 1.2 | 0.0 |
| 64.00- | 0.0 | 0.0 |
| 50% D value (μm) | 26.3 | 19.3 |

On the surface of the above-described ZnS:Cu phosphor particles a titanium oxide film was formed and further a silicon oxide was formed for damp-proof processing. This damp-proof coated ZnS:Cu phosphor particle was used to produce a switch illuminating EL sheet as follows. First, as a transparent protection film, a PET film (made by Toray product name: Lumirror S10) having a thickness of 12 μm was prepared, and a base material film having a light adhesive layer (made by Lintec Corporation, product name: PT125, thickness: 140 μm (including a light adhesive layer)) was affixed thereon to form an application base material. On a transparent protection film of this application base material (affixation base material) a transparent conductive polymer (made by AGFA, product name: P3040) was applied by screen printing and dried. In this manner, a transparent electrode layer was formed having a thickness of 2 to 4 μm, surface resistance of 500 to 800Ω/□ and light transmittance of 60% to 70%.

Next, on the above-described damp-proof coated ZnS:Cu phosphor, EL binder paint (made by Dupont, product name: 7155N), was mixed so that a binder mass ratio thereof was 1.5 times by amount, thereby preparing EL phosphor paint. This EL phosphor paint was applied by screen printing on the transparent protection film having the above-described transparent electrode layer and dried to form a light emitting layer (phosphor layer). On this light emitting layer, EL dielectric paint (made by Dupont, product name: 7153N) was applied by screen printing and dried to form a dielectric layer. Further, a conductive paste (made by Dupont, product name: Carbon Paste 7152) was applied by screen printing and dried to form a back electrode layer. Thereafter, insulation paint (made by Dupont, product name: UV CURE INK 5018) was applied and dried to thereby produce a switch illuminating EL sheet. This switch illuminating EL sheet was subjected to later-described characteristics evaluation.

EXAMPLE 2

Similarly to the above-described example 1, first a ZnS:Cu phosphor having a 50% D value of 26.3 μm was produced. This phosphor powder was re-sifted by a 500-mesh sifter to obtain a target EL phosphor. The particle distribution of this EL phosphor (ZnS:Cu phosphor) was measured similarly to the example 1. When a 50% D value was obtained as a mean particle diameter from results of this particle distribution measurements the 50% D value was 22.9 μm. Also, a ratio of coarse particle constitutes having a particle diameter of 25.4 μm or larger was 29.6% by mass. Except using this EL phosphor (ZnS:Cu phosphor) a switch illuminating EL sheet was produced similarly to the example 1. This switch illuminating EL sheet was subjected to the later-described characteristics evaluation.

EXAMPLE 3

Similarly to the above-described example 1, first a ZnS:Cu phosphor having a 50% D value of 26.3 μm was produced. This phosphor powder was re-sifted by a 635-mesh sifter to obtain a target EL phosphor. The particle distribution of this phosphor (ZnS:Cu phosphor) was measured similarly to the example 1. Results of the particle distribution measurement are as shown in Table 1. When a 50% D value was obtained as a mean particle diameter from results of this particle distribution measurement, the 50% D value was 19.3 μm. Also, a ratio of coarse particle constitutes having a particle diameter of 25.4 μm or larger was 14.4% by mass. Except using this EL phosphor (ZnS:Cu phosphor), a switch illuminating EL sheet was produced similarly to the example 1. This switch illuminating EL sheet was subjected to the later-described characteristics evaluation.

EXAMPLE 4

Similarly to the above-described example 1, first a ZnS:Cu phosphor having a 50% D value of 21.5 μm was produced. This phosphor powder was re-sifted by a 635-mesh sifter to obtain a target EL phosphor. The particle distribution of this phosphor (ZnS:Cu phosphor) was measured similarly to the example 1. When a 50% D value was obtained as a mean particle diameter from results of this particle distribution measurement, the 50% D value was 13.2 μm. Also, a ratio of coarse particle constitutes having a particle diameter of 25.4 μm or larger was 3.6% by mass. Except using this EL phosphor (ZnS:Cu phosphor) a switch illuminating EL sheet was produced similarly to the example 1. This switch illuminating EL sheet was subjected to the later-described characteristics evaluation.

EXAMPLE 5

Based on conditions described in examples in the aforementioned U.S. Pat. No. 5,643,496, a small-particle EL phosphor (ZnS:Cu phosphor) was produced. This small-particle EL phosphor was not subjected to sifting, but was made to be small particles by controlling burning conditions. Burning conditions are such that a first burning is at 1160° C. for 3.7 hours and a second burning temperature is at 730° C. The mean particle diameter (50% D value) of this small-particle EL phosphor was 23, and the ratio of coarse particle constituents having a particle diameter of 25.4 μm was 36% by mass. Except using this EL phosphor (ZnS:Cu phosphor, a switch illuminating EL sheet was produced similarly to the example 1. This switch illuminating EL sheet was subjected to the later-described characteristics evaluation.

EXAMPLE 6

Except using a PET film having a thickness of 24 μm for the transparent protection film and using the EL phosphor (ZnS:Cu phosphor) produced in the above-described example 3 a switch illuminating EL sheet was produced similarly to the example 1. This switch illuminating EL sheet was subjected to the later-described characteristics evaluation.

EXAMPLE 7

Except using a PET film having a thickness of 50 μm for the transparent protection film and using the EL phosphor (ZnS:Cu phosphor) produced in the above-described example 3, a switch illuminating EL sheet was produced similarly to the example 1. This switch illuminating EL sheet was subjected to the later-described characteristics evaluation.

EXAMPLE 8

Except that an application thickness of the conductive polymer is smaller than 1 μm and using the EL phosphor (ZnS:Cu phosphor) produced in the above-described example 3, a switch illuminating EL sheet was produced similarly to the example 1. This switch illuminating EL sheet was subjected to the later-described characteristics evaluation.

EXAMPLE 9

Except providing two systems of power supply wires to the back electrode and the transparent electrode in the above-described example 6, a switch illuminating EL sheet was produced similarly to the example 6. This switch illuminating EL sheet was subjected to the later-described characteristics evaluation.

EXAMPLE 10

First, a PET film having a thickness of 24 μm subjected to easy-adhesion processing was used as a transparent protection film, and a base material film having a light adhesive layer (PET film having a thickness of 125 μm) was affixed thereon to produce an application base material. On the other hands to 100 parts by mass of a dye filter paint binder (made by Teikoku Ink, product name: 000 Medium), 22 parts by mass of phosphor pigment (made by Sinloihi, product name: FA005) was added, mixed and dispersed to prepare dye filter paint. This dye filter paint was applied by screen printing on the transparent protection film of the application base material (affixation base material) and dried to form a dye filter layer.

On the above-described dye filter layer, a transparent conductive polymer (made by AGFA, product name: P3040) was applied by screen printing and dried. In this manner, a transparent electrode layer was formed having a thickness of 2 to 4 μm, surface resistance of 500 to 800Ω/□, and light transmittance of 60% to 70%. Except using this transparent protection film having the dye filter layer and the transparent electrode layer and using the EL phosphor (ZnS:Cu phosphor) produced in the above-described example 3, a switch illuminating EL sheet was produced similarly to the example 1. This switch illuminating EL sheet was subjected to the later-described characteristics evaluation.

EXAMPLE 11

Except arranging pads having a diameter of 6 mm and a thickness of 2 μm to 50 μm on a transparent protection film on an EL sheet surface in the above-described example 1, a switch illuminating EL sheet was produced similarly to the example 1. The pads were arranged respectively at center portions of a light emitting portion pattern corresponding to switches. This switch illuminating EL sheet was subjected to the later-described characteristics evaluation.

EXAMPLE 12

On a transparent protection film (made by Toppan, product name: GX film) having a thickness of 12 μm and subjected to damp-proof processing, a base material film having a light adhesive layer (PET film having a thickness of 125 μm) was affixed to make an application base material. Except using this application base material, a switch illuminating EL sheet was produced similarly to the example 3. Not that a back insulation layer was formed such that a protection film made by Toppan, product name: GX film) having a thickness of 12 μm with a hot melt made by Mitsui-Dupont Polychemical, product name: EEA) being applied thereon was affixed by laminating by means of thermo rolling. This switch illuminating EL sheet was subjected to the later-described characteristics evaluation.

Comparative Example 1

Except using a PET film having a thickness of 9 μm for the transparent protection film, a switch illuminating EL sheet was produced similarly to the example 3. This switch illuminating EL sheet was subjected to the later-described characteristics evaluation.

Comparative Example 2

Except using a PET film having a thickness of 63 μm for the transparent protection film, a switch illuminating EL sheet was produced similarly to the example 3. This switch illuminating EL sheet was subjected to the later-described characteristics evaluation.

Comparative Example 3

First, ITO indium tin oxide) was deposited on a polyester film having a thickness of 75 μm to produce a transparent electrode film. The transparent electrode layer constituted of an ITC deposition film had a thickness of 0.1 μm or smaller surface resistance of approximately 300Ω/□ and light transmittance of 85% or higher. Except using this transparent electrode film (ITO film) a switch illuminating EL sheet was produced similarly to the example 3. This switch illuminating EL sheet was subjected to the later-described characteristics evaluation.

Initial luminance, clicking feeling and keystroke durability of the switch illuminating EL sheets of the above-described examples 1 to 12 and comparative examples 1 to 3 were measured and evaluated as follows. Constitutions of the respective EL sheets are shown in Table 2. Further, characteristics evaluation results of the respective EL sheets are shown in Table 3. Then, measurement of thicknesses of respective films and applied film thicknesses were conducted as follows. On a support table arranged vertically with respect to a measurement table made of stainless steel, a Digimatic Indicator (made by Mitutoyo, product name: ID-c112B) was set and a sample to be measured was horizontally placed statically on the measurement tables and thereafter a probe was silently lowered to the table as a measurement origin and film thickness measurement was performed five times. Regarding thicknesses of the films, a mean value of three times was taken as a measurement value excluding a largest value and a smallest value. Applied film thicknesses were shown in ranges of respective measurement values. Mean applied film thicknesses were measured similarly to the thicknesses of the films.

Regarding initial luminance of an EL sheets the EL sheet was lighted under conditions of a voltage of 100 V and a frequency of 400 Hz in a dark place of 10 lux or lower at room temperature in a normal humidity, and one minute later its luminance was measured by a colorimeter CS-100 made by Minolta which was taken as the initial luminance. Regarding the keystroke durability, an impact test of the center of a light emitting portion was performed with a condition of 3N, 180 times/minute using an ABS resin stick having a diameter of 1.5 mm with an edge being processed by radius of 0.1 mm and the impact test was repeated until the impact position breaks or abnormality occurred in emitting light, thereby performing evaluation by the number of impacts thereof.

Regarding the clicking feelings a probe having a diameter of 1.5 mm is contacted on the center of a particular metal dome and weight was applied vertically to click it, thereby taking clearness of clicking feeling when pushing and returning as the standard for clicking feeling. Similarly, a change in clicking feeling when an EL panel was placed on a metal dome was evaluated by sensitivity in the order of fewness of deterioration such that "A"=clicking feeling did not change, "B"=clicking feeling did not change largely, "C"=clicking feeling was heavy and deterioration was sensed, and "D"=clicking feeling was deteriorated and not sensed.

TABLE 2

| | Constitution of EL sheets | | | | | | | |
|---|---|---|---|---|---|---|---|---|
| | Transparent electrode layer | | | Protection | Pigment | Damp-proof | EL phosphor | |
| | Material | Thickness (μm) | Surface resistance (Ω/□) | film thickness (μm) | layer exist or not | layer exist or not | Mean particle diameter (μm) | Raito of particle of 25.4 μm or larger (%) |
| Example 1 | Conductive polymer | 2 to 4 | 500 to 800 | 12 | No | No | 26.3 | 54.5 |
| Example 2 | Conductive polymer | 2 to 4 | 500 to 800 | 12 | No | No | 22.7 | 29.6 |
| Example 3 | Conductive polymer | 2 to 4 | 500 to 800 | 12 | No | No | 19.3 | 14.3 |
| Example 4 | Conductive polymer | 2 to 4 | 500 to 800 | 12 | No | No | 13.2 | 3.6 |
| Example 5 | Conductive polymer | 2 to 4 | 500 to 800 | 12 | No | No | 23.7 | 39.6 |
| Example 6 | Conductive polymer | 2 to 4 | 500 to 800 | 24 | No | No | 19.3 | 14.4 |
| Example 7 | Conductive | 2 to 4 | 500 to 800 | 50 | No | No | 19.3 | 14.4 |

TABLE 2-continued

| | Constitution of EL sheets | | | | | | | |
|---|---|---|---|---|---|---|---|---|
| | Transparent electrode layer | | | Protection | Pigment | Damp-proof | EL phosphor | |
| | Material | Thick-ness (μm) | Surface resistance (Ω/□) | film thickness (μm) | layer exist or not | layer exist or not | Mean particle diameter (μm) | Raito of particle of 25.4 μm or larger (%) |
| | polymer | | | | | | | |
| Example 8 | Conductive polymer | to 1 | 1000 to | 12 | No | No | 19.3 | 14.4 |
| Example 9 | Conductive polymer | 2 to 4 | 500 to 800 | 24 | No | No | 19.3 | 14.4 |
| Example 10 | Conductive polymer | 2 to 4 | 500 to 800 | 24 | Yes | No | 19.3 | 14.4 |
| Example 11 | Conductive polymer | 2 to 4 | 500 to 800 | 12 | No | No | 26.3 | 54.5 |
| Example 12 | Conductive polymer | 2 to 4 | 500 to 800 | 12* | No | Yes | 19.3 | 14.4 |
| Comparative example 1 | Conductive polymer | 2 to 4 | 500 to 800 | 9 | No | No | 19.3 | 14.4 |
| Comparative Example 2 | Conductive polymer | 2 to 4 | 500 to 800 | 63 | No | No | 19.3 | 14.4 |
| Comparative Example 3 | ITO | to 0.1 | 300 | 75 | No | No | 19.3 | 14.4 |

*= a damp-proof layer is added.

TABLE 3

| | Performance of EL sheet | | | |
|---|---|---|---|---|
| | Initial luminance (cd/m$^2$) | Clicking feeling | Keystroke durability (million times) | Note |
| Example 1 | 57 | A | C(100)* | *= black dot like minute defect |
| Example 2 | 65 | A | B(150) | |
| Example 3 | 70 | A | B(150) | |
| Example 4 | 85 | A | B(150) | |
| Example 5 | 40 to 45 | A | C(100)* | *= black dot like minute defect |
| Example 6 | 70 | A | A(200) | |
| Example 7 | 70 | B | A(200) | |
| Example 8 | 70 | A | C(100)* | *= black dot like minute defect |
| Example 9 | 70 | A | A(200) | double wires of power supply portions |
| Example 10 | 50* | A | A(200) | *= luminance decreased due to pigment layer including pad |
| Example 11 | 57 | A | A(200) | |
| Example 12 | 70 | B | A(200) | |
| Comparative Example 1 | 70 | A | D( to 100)* | *= black dot like minute defect, protection film broken |
| Comparative Example 2 | 70 | C | A(300 to ) | |
| Comparative Example 3 | 100 | D | D( to 50)* | *= black dot like minute defect |

As is clear from Table 3, the comparison example 1 using the transparent protection film having a thickness smaller than 10 μm is excellent in clicking feeling, but the transparent protection film was broken by impact tests of one million times or less. Considering clicking feeling and a mounting space, a light emitting portion that is as thin as possible is desirable, but it can be seen that the transparent protection film having a thickness smaller than 10 μm easily breaks and thus cannot satisfy required characteristics for hitting durability. In the comparison example 2 using a transparent protection film having a thickness larger than 60 μm, durability of three million times can be assured by the impact test, but it can be seen that the clicking feeling decreases and thus not suitable for practical use. The EL sheet of the example 3 using an ITO electrode exhibited luminance as high as 100 cd/m$^2$, but it can be seen that it cannot obtain clicking feeling and keystroke durability required for a switch.

on the other hand, the EL sheets of the examples 1 to 12 are all excellent in clicking feeling and also capable of obtaining the durability of at least one million times by the impact test. In other words, the EL sheet of the example 1 is excellent in clicking feeling, and although a non light emitting portion like a minute black dot is seen in a keystroke portion by one million times of keystroke tests, it did not stands out in appearance in practical use, thereby obtaining even light as the illumination source of a key switch. Also, in the examples 2 to 4, and 6 to 9 in which coarse phosphor particles are removed by sifting to control the mean particle diameters to be in the range of 10 to 23 μm and the ratio of coarse particle constituents having a particle diameter of 25.4 μm or larger to be 30% or less by mass, it can be seen that the luminance of the EL sheet is further improved as compared to the example 1.

Moreover, it can be seen that the example 9 having two systems of power supply wires are further improved in keystroke reliability. The example 10 has slightly decreased luminance by adding the pigment layer, but its practical characteristics can be improved based on the pigment layer. The example 11 has key stroke reliability improved further by the pads. For the EL sheet of the example 12, lighting tests were performed with drive conditions of one-side wave 200 Vp-p, 600 Hz in an environment of 40° C. and 95% RH. In such tests, normally the conductive polymer disintegrated to cause failure to light after approximately two hours whereas the EL sheet of the example 12 lighted normally for six hours or longer, and thus it was confirmed to have a long life in high-temperature, high-humidity environment.

INDUSTRIAL APPLICABILITY

By a switch illuminating EL sheet according to the present invention, when being used as an illumination light source or the like for a key switch, wire breakage and failure to light due to keystroke stress or the like can be suppressed repetitively without impairing reliability and clicking feeling of a key switch or the like. Therefore, the switch illuminating EL sheet according to the present invention is effective as a light source for an illuminated switch. Further, the illuminated switch according to the present invention can be made thinner, and is excellent in reliability, clicking feeling, and so forth. Thus, the illuminated switch according to the present invention is effective for various electric/electronic apparatuses.

What is claimed is:

1. A switch illuminating EL (electroluminescence) sheet having a light emitting pattern corresponding to a switch, comprising:

a light emitting layer having EL phosphor particles which are contained dispersedly in a dielectric matrix, each of the EL phosphor particles having a damp-proof coating formed on a surface thereof;

a transparent electrode layer arranged along a light emitting face of the light emitting layer and constituted of a conductive polymer;

a transparent protection film arranged on the transparent electrode layer and having a thickness of 10 μm to 60 μm; and a dielectric layer and a back electrode layer which are arranged in order along a non light emitting face of the light emitting layer.

2. The switch illuminating EL sheet according to claim 1, wherein the EL phosphor particles are constituted of ZnS-based EL phosphors.

3. The switch illuminating EL sheet according to claim 2, wherein the EL phosphor particles have a mean particle diameter of 10 μm to 23 μm and a particle distribution including 30% or less by mass of constituents having a particle diameter of 25.4 μm or larger.

4. The switch illuminating EL sheet according to claim 3, wherein the EL phosphor particle has luminance of 80 cd/m2 or higher under drive conditions of a voltage of 100 V and a frequency of 400 Hz when an EL element is produced using a transparent electrode having light transmittance of 85% or higher and surface resistance of 500Ω/□ or lower.

5. The switch illuminating EL sheet according to claim 1, wherein the damp-proof coating is constituted of a metal oxide film or a metal nitride film.

6. The switch illuminating EL sheet according to claim 1, wherein the damp-proof coating has a mean film thickness of 0.1 μm to 2 μm.

7. The switch illuminating EL sheet according to claim 3, wherein the switch illuminating EL sheet exhibits luminance of 50 cd/m2 or higher under drive conditions of a voltage of 100 V and a frequency of 400 Hz.

8. The switch illuminating EL sheet according to claim 1, wherein the transparent electrode layer constituted of the conductive polymer has a mean thickness of 0.1 μm or larger, and surface resistance of 1000Ω/□ or lower and light transmittance of less than 80%.

9. The switch illuminating EL sheet according to claim 1, further comprising:

a back insulation layer arranged on the back electrode layer.

10. An illuminated switch comprising a switch illuminating EL sheet according to claim 1.

11. The illuminated switch according to claim 10, comprising:

a switch mechanism portion;

a key top portion which operates the switch mechanism portion; and the switch illuminating EL sheet arranged between the switch mechanism portion and the key top portion, and illuminating the key top portion.

12. The illuminated switch according to claim 11, wherein the switch mechanism portion has a dome type movable contact point and a fixed point arranged on a substrate.

13. An electronic apparatus comprising an illuminated switch according to claim 10.

14. The electronic apparatus according to claim 13, wherein the electronic apparatus is a mobile communication apparatus.

15. An illuminated switch, comprising:

a plurality of switch mechanism portions;

a plurality of key top portions which operate the plurality of switch mechanism portions; and an electroluminescence (EL) sheet, arranged between the plurality of switch mechanism portions and the plurality of key top portions, having a pattern of light emitting portions corresponding to the plurality of key top portions;

wherein the electroluminescence sheet includes light emitting layers corresponding to the light emitting portions, transparent electrode layers, arranged along light emitting faces of the light emitting layers, corresponding to the light emitting portions, a first power supply wire connecting the transparent electrode layers, a transparent protection film arranged on the transparent electrode layers, dielectric layers arranged along non-light emitting faces of the light emitting layers, a back electrode layer having electrode portions, arranged at the non-light emitting faces of the light emitting layers through the dielectric layers, corresponding to the light emitting portions and a second power supply wire connecting the electrode portions, a first power supply terminal connected to the first power supply wire, and a second power supply terminal connected to the second power supply wire;

wherein the light emitting layers have electroluminescence phosphor particles which are contained dispersedly in a dielectric matrix, the transparent electrode layers are constituted of a conductive polymer, and the transparent protection film has a thickness of 10 μm to 60 μm;

wherein the first power supply wire has two or more systems of lines connected to the first power supply terminal that can be used independently of each other to supply power and illuminate the light emitting portions, and the second power supply wire has two or more systems of lines connected to the second power supply terminal that can be used independently of each other to supply power and illuminate the light emitting portions.

16. The illuminated switch according to claim 15, wherein the switch mechanism portions each have a dome type movable contact point and a fixed contact point arranged on a substrate.

17. The illuminated switch according to claim 15, further comprising:

resin pads arranged at positions corresponding to centers of the light emitting portions on at least one of a front face and a back face of the electroluminescence sheet.

18. The illuminated switch according to claim 15, wherein the electroluminescence phosphor particles are constituted of a ZnS-based electroluminescence phosphor.

19. The illuminated switch according to claim 15, wherein the electroluminescence phosphor particles each have a damp-proof coating formed an a surface thereof.

20. The illuminated switch according to claim 15, wherein the electroluminescence sheet includes a back insulation layer arranged on the back electrode layer.

21. A method for producing an illuminated switch, comprising:

producing an electroluminescence (EL) sheet having a pattern of light emitting portions, and including:

forming transparent electrode layers corresponding to the light emitting portions on a transparent protection film having a thickness of 10 μm to 60 μm, the transparent electrode layers being constituted of a conductive polymer;

forming a first power supply wire connecting the transparent electrode layers;

forming light emitting layers corresponding to the light emitting portions on the transparent electrode layers, the light emitting layers having electroluminescence phosphor particles which are contained dispersedly in a dielectric matrix;

forming dielectric layers corresponding to the light emitting portions on the light emitting layers;

forming a back electrode layer on the transparent protection film having the transparent electrode layers, the light emitting layers and the dielectric layers, the back electrode layer having electrode portions corresponding to the light emitting portions and a second power supply wire connecting the electrode portions;

preparing a first power supply terminal connected to the first power supply wire; and preparing a second power supply terminal connected to the second power supply wire; and producing the illuminated switch by arranging the electroluminescence sheet between a plurality of switch mechanism portions and a plurality of key top portions which operate the plurality of switch mechanism portions so that the light emitting portions correspond with the key top portions wherein the first power supply wire has two or more systems of lines connected to the first power supply terminal that can be used independently of each other to supply power and illuminate the light emitting portions, and the second power supply wire has two or more systems of lines connected to the second power supply terminal that can be used independently of each other to supply power and illuminate the light emitting portions.

22. The method for producing the illuminated switch according to claim 21, wherein the switch mechanism portions have dome type movable contact points and fixed contact points arranged on a substrate, and the movable contact points and the fixed contact pints are arranged so as to correspond with the key top portions.

23. The method for producing the illuminated switch according to claim 21, further comprising:

arranging resin pads at positions corresponding to centers of the light emitting portions on at least one of a front face and aback face of the electroluminescence sheet.

24. The method for producing the illuminated switch according to claim 21, wherein the electroluminescence phosphor particles each have a damp-proof coating formed on a surface thereof.

25. The method for producing the illuminated switch according to claim 21, wherein the electroluminescence sheet producing includes arranging a back insulation layer on the back electrode layer.

* * * * *